US011732681B2

(12) United States Patent
Ohashi et al.

(10) Patent No.: US 11,732,681 B2
(45) Date of Patent: Aug. 22, 2023

(54) EGR DEVICE

(71) Applicant: TOYOTA BOSHOKU KABUSHIKI KAISHA, Aichi-ken (JP)

(72) Inventors: Junichi Ohashi, Chita (JP); Yasuhiro Saito, Tokoname (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 17/694,934

(22) Filed: Mar. 15, 2022

(65) Prior Publication Data

US 2022/0298992 A1 Sep. 22, 2022

(30) Foreign Application Priority Data

Mar. 22, 2021 (JP) ..... 2021-047899

(51) Int. Cl.
*F02M 26/44* (2016.01)
*F02M 26/17* (2016.01)
(Continued)

(52) U.S. Cl.
CPC ..... *F02M 26/44* (2016.02); *F02M 26/17* (2016.02); *F02M 26/20* (2016.02); *F02M 35/10222* (2013.01)

(58) Field of Classification Search
CPC ..... F02M 26/17; F02M 26/19; F02M 26/20; F02M 26/41; F02M 26/44; F02M 35/10222
See application file for complete search history.

(56) References Cited

U.S. PATENT DOCUMENTS 6,334,437 B1 * 1/2002 Jessberger ..... F02M 26/44 123/568.12
11,008,983 B1 * 5/2021 Yoshioka ..... F02M 26/19
(Continued)

FOREIGN PATENT DOCUMENTS

CN 112211758 1/2021
DE 19909433 C1 * 4/2000 ..... F02M 25/0703
(Continued)

OTHER PUBLICATIONS

Office Action issued in Corresponding CN Patent Application No. 202210235976.1, dated Mar. 21, 2023, along with an English translation thereof.

*Primary Examiner* — John M Zaleskas
(74) *Attorney, Agent, or Firm* — Greenblum & Bernstein, P.L.C.

(57) ABSTRACT

An EGR device includes an inlet portion into which EGR gas is introduced, a first outlet portion, a second outlet portion, and a passage portion. The first outlet portion and the second outlet portion each conduct, to the corresponding branch passage portion, the EGR gas that has been introduced through the inlet portion. The passage portion allows gas to flow between the inlet portion and the first outlet portion and between the inlet portion and the second outlet portion. The passage portion includes: a main passage that connects the inlet portion to the first outlet portion and to the second outlet portion; and an expansion chamber that is expanded outward from the main passage. The main passage includes a connecting portion. The connecting portion is connected to the second outlet portion and extends in a first direction. The expansion chamber is expanded outward from the connecting portion.

3 Claims, 3 Drawing Sheets

(51) Int. Cl.
*F02M 26/20* (2016.01)
*F02M 35/10* (2006.01)

(56) References Cited

U.S. PATENT DOCUMENTS

2009/0223476 A1* 9/2009 Shinkai ..... F02M 26/12 123/184.21
2014/0014056 A1* 1/2014 Sato ..... F02M 35/10072 123/184.47
2017/0211519 A1* 7/2017 Ito ..... F02M 35/10222
2017/0226968 A1* 8/2017 Nakamura ..... F02M 26/20
2017/0241377 A1* 8/2017 Ito ..... F02M 35/10
2017/0284342 A1* 10/2017 Terai ..... F02M 26/41
2017/0306895 A1* 10/2017 Teramoto ..... F02M 26/20
2018/0045150 A1* 2/2018 Ito ..... F02M 35/10222
2018/0119655 A1* 5/2018 Ito ..... F02M 35/10144
2018/0149120 A1* 5/2018 Ito ..... F02M 26/13
2018/0171944 A1* 6/2018 Nakamura ..... F02M 35/10157
2018/0283325 A1* 10/2018 Nagata ..... F02M 35/10222
2018/0347520 A1* 12/2018 Sakurai ..... F02M 25/06
2019/0136803 A1* 5/2019 So ..... F02M 35/10222
2019/0170095 A1* 6/2019 Yasue ..... F02M 26/42
2019/0219005 A1* 7/2019 Wicks ..... F02M 35/10222
2020/0408174 A1* 12/2020 Sumi ..... F02M 26/20
2021/0010446 A1* 1/2021 Yoshioka ..... F02M 35/10222
2021/0172411 A1* 6/2021 Itagaki ..... F02M 35/10222
2021/0199075 A1* 7/2021 Yoshioka ..... F02M 26/17
2021/0277850 A1* 9/2021 Yoshioka ..... F02M 26/11
2021/0293206 A1* 9/2021 Miyashita ..... F02M 26/20
2021/0372352 A1* 12/2021 Yoshioka ..... F02M 26/06

FOREIGN PATENT DOCUMENTS

JP 2000192862 A * 7/2000 ..... F02M 26/19
JP 2012-225170 11/2012
JP 2019085992 A * 6/2019 ..... F02M 25/0703

* cited by examiner

EGR DEVICE

BACKGROUND

1. Field

The present disclosure relates to an exhaust gas recirculation (EGR) device.

2. Description of Related Art

Japanese Laid-Open Patent Publication No. 2012-225170 discloses an EGR device, which recirculates some of the exhaust gas discharged from an internal combustion engine to an intake passage. The EGR device disclosed in the publication includes an inlet portion for introducing EGR gas and outlet portions for conducting the EGR gas out. The outlet portions are respectively connected to different ones of branch passage portions in the intake passage. The inlet portion and the outlet portions are connected to each other by a passage portion. The EGR gas introduced into the inlet portion flows to the outlet portions through the passage portion and is conducted to the branch passage portions.

The EGR gas is guided to the outlet portions from the inlet portion by intake vacuum in the branch passage portions. The outlet portions of the EGR device disclosed in the above-described publication are respectively connected to different ones of the branch passage portions. Thus, intake vacuum produced in one of the branch passage portions that causes EGR gas to flow from the inlet portion toward the corresponding outlet portion also causes fresh air to flow backward from the other branch passage portions into the EGR device via the other outlet portions. The fresh air that has flowed backward may join and be mixed into the flow of EGR gas. The fresh air mixed into EGR gas dilutes the EGR gas and thus changes the amount of EGR gas in the EGR device. Such a phenomenon is not disclosed in the above-described publication. In that regard, the EGR device of the publication still has room for improvement.

SUMMARY

It is an objective of the present disclosure to provide an EGR device that limits mixing of fresh air into EGR gas, thereby ensuring a sufficient amount of EGR gas.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an EGR device is provided that is configured to recirculate, as an EGR gas, some of an exhaust gas discharged from an internal combustion engine to branch passage portions provided in an intake passage. The EGR device includes an inlet portion into which the EGR gas is introduced, a first outlet portion, a second outlet portion, and a passage portion. The first outlet portion and a second outlet portion are connected to different ones of the branch passage portions. The first outlet portion and the second outlet portion each conduct, to the corresponding branch passage portion, the EGR gas that has been introduced through the inlet portion. The passage portion allows gas to flow between the inlet portion and the first outlet portion and between the inlet portion and the second outlet portion. The passage portion includes a main passage and an expansion chamber. The main passage connects the inlet portion to the first outlet portion and to the second outlet portion. The expansion chamber is expanded outward from the main passage. The main passage includes a connecting portion. The connecting portion is connected to the second outlet portion and extends in a first direction. The expansion chamber is expanded outward from the connecting portion.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

In this specification, "at least one of A and B" should be understood to mean "only A, only B, or both A and B."

An EGR device 20 according to one embodiment will now be described with reference to FIGS. 1 to 5. The EGR device 20 of the present embodiment is formed integrally with an intake manifold 10, which is made of a plastic.

Figure 1:
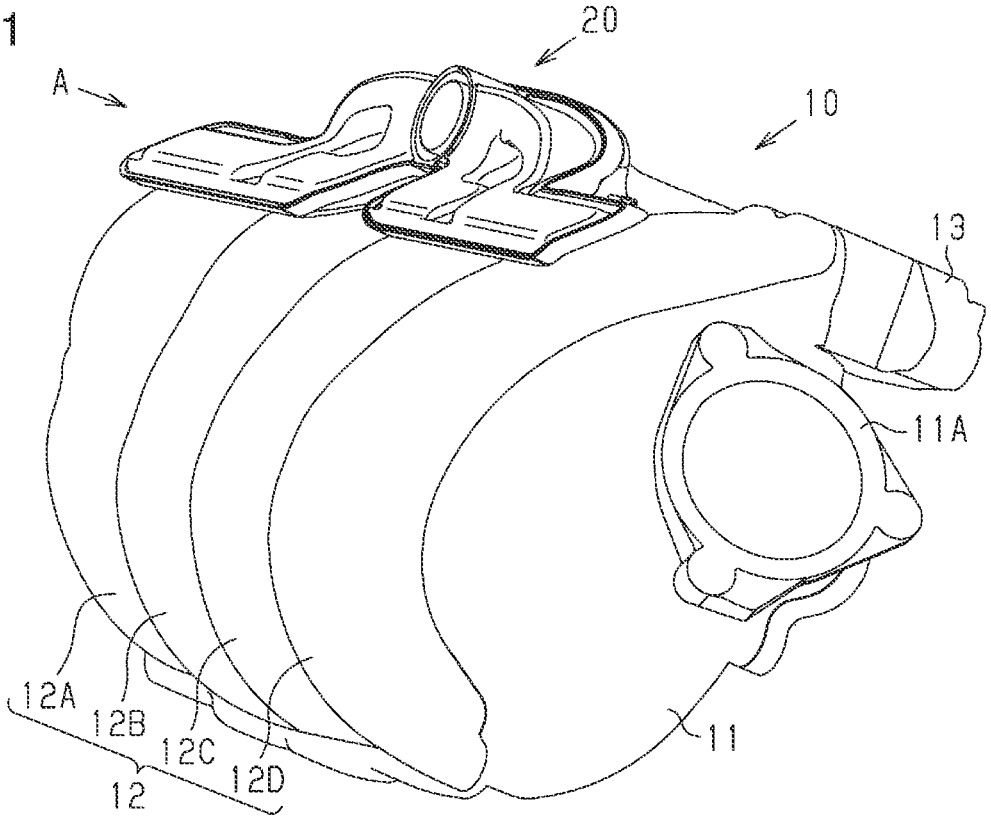
FIG. 1 is a perspective view schematically showing a structure of an intake manifold that includes an EGR device according to one embodiment.

As shown in FIG. 1, the intake manifold 10 includes a surge tank 11. The surge tank 11 includes a first flange 11A, to which a throttle valve (not shown) is attached. A lower part of the surge tank 11 is connected to branch passage portions 12, the number of which is four in the present embodiment. The branch passage portions 12 extend from the lower part to an upper part of the surge tank 11 along the outer periphery of the surge tank 11. In the following description, the branch passage portions 12 will be referred to as a first branch passage portion 12A, a second branch passage portion 12B, a third branch passage portion 12C, and a fourth branch passage portion 12D as arranged in order from the side farthest from the first flange 11A.

Each of the branch passage portions 12 is provided with a second flange 13 at a distal end. The second flanges 13 are coupled to a cylinder head of an internal combustion engine (not shown). The intake manifold 10 conducts fresh air that has been introduced into the surge tank 11 through the first flange 11A to intake ports in the cylinder head through the branch passage portions 12. As described above, the intake manifold 10 includes an intake passage that delivers fresh air to the internal combustion engine.

The EGR device 20 is located in an upper portion of the intake manifold 10. That is, the EGR device 20 is arranged on the outer side of distal end portions of the branch passage portions 12.

Figure 2:
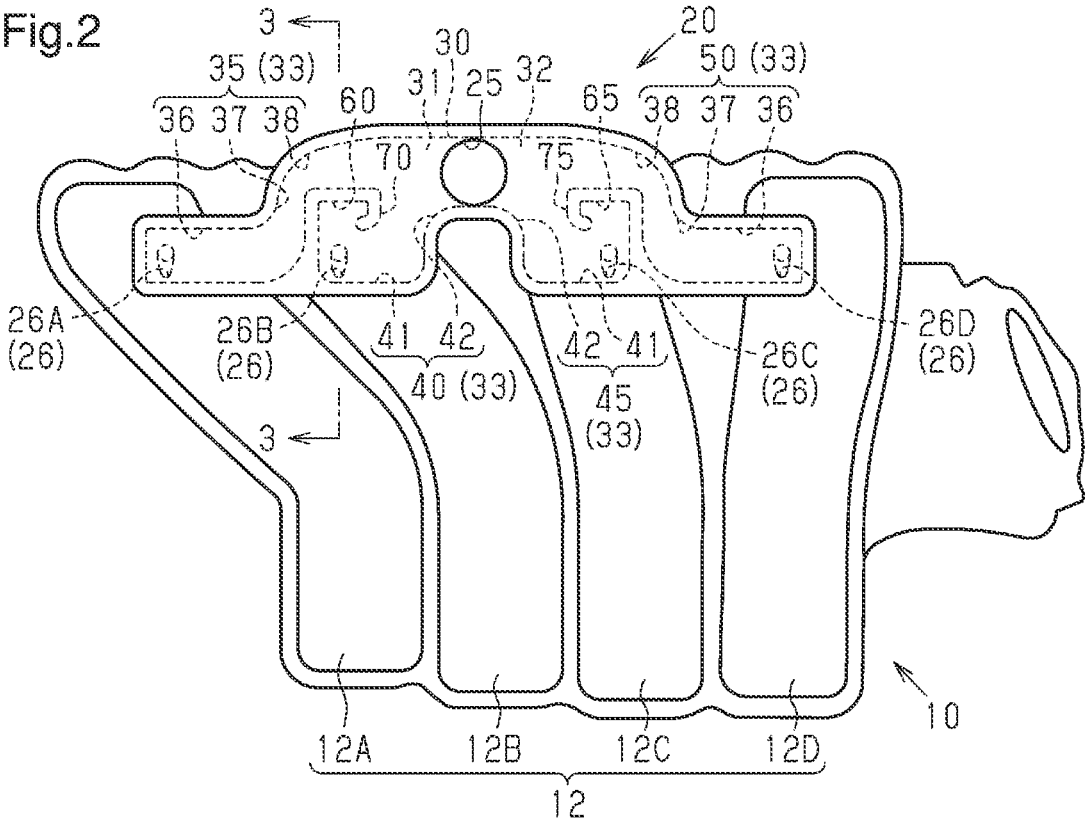
FIG. 2 is a schematic diagram of the intake manifold as viewed in a direction of arrow A in FIG. 1.

As shown in FIG. 2, the EGR device 20 extends across the branch passage portions 12.

Figure 3:
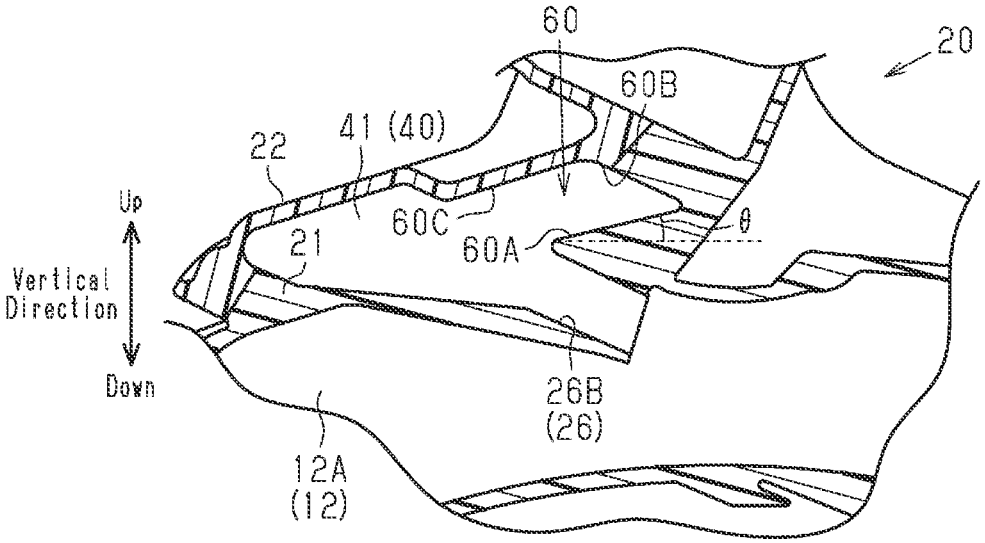
FIG. 3 is a cross-sectional view taken along line 3-3 of FIG. 2.

As shown in FIG. 3, the EGR device 20 includes a first segment 21 and a second segment 22. The first segment 21 is made of a plastic and includes an outer peripheral wall of the branch passage portions 12, and the second segment 22 is made of a plastic and joined to the first segment 21.

As shown in FIG. 2, the EGR device 20 includes an inlet portion 25, into which some of exhaust gas discharged from the internal combustion engine is introduced as EGR gas. Also, the EGR device 20 includes outlet portions 26, which conduct EGR gas introduced through the inlet portion 25 to the branch passage portions 12. The outlet portions 26 are respectively connected to different ones of the branch passage portions 12. In the present embodiment, the outlet portion 26 connected to the first branch passage portion 12A is referred to as a first outlet portion 26A, and the outlet portion 26 connected to the second branch passage portion 12B is referred to as a second outlet portion 26B. Also, the outlet portion 26 connected to the third branch passage portion 12C is referred to as a third outlet portion 26C, and the outlet portion 26 connected to the fourth branch passage portion 12D is referred to as a fourth outlet portion 26D. The outlet portions 26 extend toward the upstream side in the flowing direction of fresh air (upward as viewed in FIG. 2), so that EGR gas can be conducted in the flowing direction of the fresh air in the branch passage portions 12.

The EGR device 20 includes a passage portion 30, which allows gas to flow between the inlet portion 25 and the outlet portions 26. The passage portion 30 includes a main passage 31, which connects the inlet portion 25 to the outlet portions 26. The main passage 31 includes a distribution chamber 32, which is connected to the inlet portion 25, and diverting passages 33, which branch from the distribution chamber 32 to the outlet portions 26. The diverting passages 33 include a first diverting passage 35, which connects the distribution chamber 32 to the first outlet portion 26A, a second diverting passage 40, which connects the distribution chamber 32 to the second outlet portion 26B, a third diverting passage 45, which connects the distribution chamber 32 to the third outlet portion 26C, and a fourth diverting passage 50, which connects the distribution chamber 32 to the fourth outlet portion 26D. The structure of the first diverting passage 35 and the structure of the fourth diverting passage 50 are bilaterally symmetrical. The structure of the second diverting passage 40 and the structure of the third diverting passage 45 are bilaterally symmetrical. In the following description, only the structures of the first diverting passage 35 and the second diverting passage 40 will be described. Regarding the structures of the third diverting passage 45 and the fourth diverting passage 50, the like or the same reference numerals are given to those components that are like or the same as the corresponding components of the first diverting passage 35 and the second diverting passage 40, and detailed explanations are omitted.

The first diverting passage 35 includes a first connecting portion 36, a first curved portion 37, and a joint portion 38. The first connecting portion 36 is connected to the first outlet portion 26A. The first connecting portion 36 extends in a first direction (left-right direction viewed in FIG. 2). The first curved portion 37 is curved and extends from the first connecting portion 36 in a second direction (up-down direction in FIG. 2), which is orthogonal to the first direction. The joint portion 38 joins the first curved portion 37 to the distribution chamber 32.

The second diverting passage 40 includes a second connecting portion 41 and a second curved portion 42. The second connecting portion 41 is connected to the second outlet portion 26B. The second connecting portion 41 extends in the first direction. The second curved portion 42 is curved and extends from the second connecting portion 41 in the second direction. A distal end of the second curved portion 42 is connected to the distribution chamber 32.

The passage portion 30 includes a first expansion chamber 60 and a second expansion chamber 65. The first expansion chamber 60 is expanded outward from the second diverting passage 40 of the main passage 31, and the second expansion chamber 65 is expanded outward from the third diverting passage 45 of the main passage 31. The structure of the first expansion chamber 60 and the structure of the second expansion chamber 65 are bilaterally symmetrical. In the following description, only the structures of the first expansion chamber 60 will be described. Regarding the structure of the second expansion chamber 65, the like or the same reference numerals are given to those components that are like or the same as the corresponding components of the first expansion chamber 60, and detailed explanations are omitted.

The first expansion chamber 60 is expanded in the second direction, which is different from the first direction, from the second connecting portion 41 in the second diverting passage 40. More specifically, the first expansion chamber 60 is expanded from the second connecting portion 41 toward the joint portion 38 of the first diverting passage 35. Thus, the cross-sectional flow area of the passage portion 30 is partially increased in a section including the first expansion chamber 60.

As shown in FIG. 3, the first expansion chamber 60 includes a bottom wall 60A, which is located in a lower part in a vertical direction (up-down direction in FIG. 3), a peripheral wall 60B, which extends from a peripheral edge of the bottom wall 60A, and an upper wall 60C, which is opposed to the bottom wall 60A and is connected to a distal end of the peripheral wall 60B. Accordingly, the first expansion chamber 60 is shaped to have an opening in a section connected to the second connecting portion 41. That is, the first expansion chamber 60 is shaped to have an opening in the side facing the second outlet portion 26B.

The bottom wall 60A is inclined by an inclination angle 0 with respect to the horizontal direction so that it becomes lower in the vertical direction toward the section connected to the second connecting portion 41. That is, the bottom wall 60A slopes down in the vertical direction toward the second outlet portion 26B.

As shown in FIG. 2, the EGR device 20 includes a first partition 70, which separates the first expansion chamber 60 and the second diverting passage 40 from each other. That is, the first partition 70 forms a part of the peripheral wall 60B of the first expansion chamber 60 and also forms a part of a side wall of the second diverting passage 40. In the second diverting passage 40, the first partition 70 is curved from an upstream section closer to the inlet portion 25 to a downstream section closer to the second outlet portion 26B. The first partition 70 guides the flow of EGR gas from the inlet portion 25 toward the second outlet portion 26B. In other words, the first partition 70 is curved with respect to the second direction to approach the second outlet portion 26B (left side in FIG. 2) toward the downstream end.

Also, the EGR device 20 includes a second partition 75, which separates the second expansion chamber 65 and the third diverting passage 45 from each other. That is, the second partition 75 forms a part of the peripheral wall 60B of the second expansion chamber 65 and also forms a part of a side wall of the third diverting passage 45. In the third diverting passage 45, the second partition 75 is curved from an upstream section closer to the inlet portion 25 to a downstream section closer to the third outlet portion 26C. The second partition 75 guides the flow of EGR gas from the inlet portion 25 toward the third outlet portion 26C. In other words, the second partition 75 is curved with respect to the second direction to approach the third outlet portion 26C (right side in FIG. 2) toward the downstream end.

Operation and advantages of the present embodiment will now be described.

Figure 4:
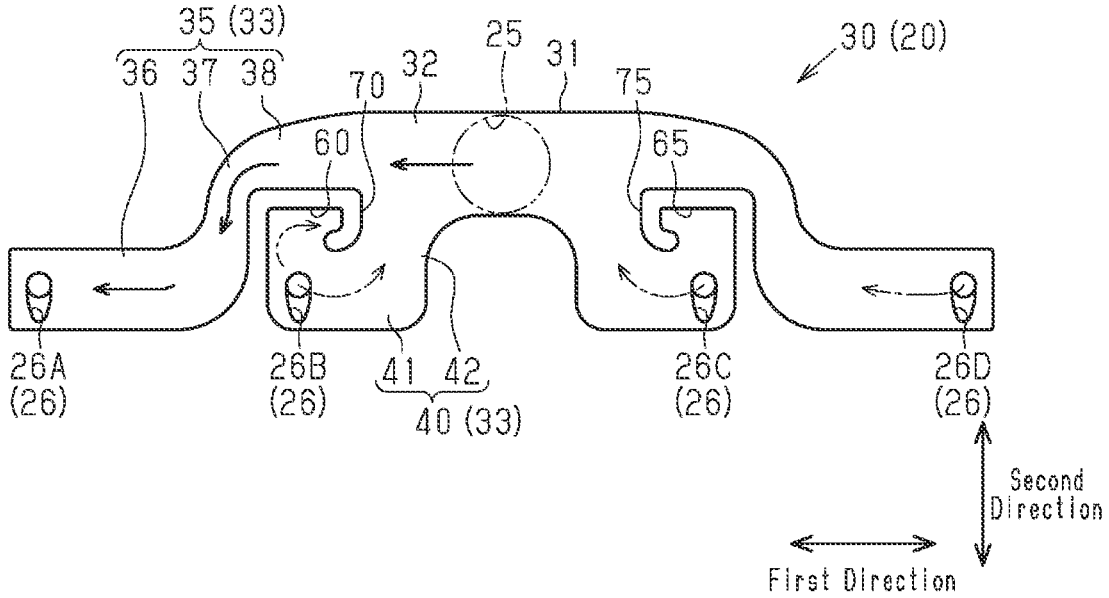
FIG. 4 is a schematic diagram showing flows of gas in the EGR device shown in FIG. 1.

(1) When intake vacuum is produced, for example, in the first branch passage portion 12A of the EGR device 20, EGR gas flows from the inlet portion 25 to the first outlet portion 26A as indicated by the solid arrows in FIG. 4. At this time, since the vacuum acts on the second outlet portion 26B, the third outlet portion 26C, and the fourth outlet portion 26D, fresh air flows backward to the EGR device 20 from the branch passage portions 12, which are connected to the outlet portions 26 of the second to fourth outlet portions 26B, 26C, 26D, as indicated by arrows of the long-dash short-dash lines in FIG. 4. In the present embodiment, the second outlet portion 26B is located at a position closer to the first outlet portion 26A than the third outlet portion 26C or the fourth outlet portion 26D. Accordingly, the fresh air that has flowed backward from the second outlet portion 26B is more likely to be mixed with EGR gas that flows to the first outlet portion 26A than the fresh air that has flowed backward from the third outlet portion 26C or the fresh air that has flowed backward from the fourth outlet portion 26D.

In the present embodiment, the passage portion 30 of the EGR device 20 includes the first expansion chamber 60 and the second expansion chamber 65, which are expanded outward from the main passage 31, in addition to the main passage 31, which includes the distribution chamber 32 and the diverting passages 33. The first expansion chamber 60 is located outward in the second direction from the second connecting portion 41 of the second diverting passage 40, which is connected to the second outlet portion 26B. Thus, as indicated by the arrow of the long-dash double-short-dash line in FIG. 4, some of the fresh air that has flowed backward to the EGR device 20 from the second branch passage portion 12B is likely to be dispersed to the first expansion chamber 60 from the second outlet portion 26B and stagnate in the first expansion chamber 60. As a result, the fresh air that has flowed backward is less likely to join the EGR gas that flows from the inlet portion 25 to the first outlet portion 26A.

Also, when intake vacuum is produced in the fourth branch passage portion 12D, the fresh air that has flowed backward from the third outlet portion 26C is likely to be mixed with the EGR gas that flows to the fourth outlet portion 26D. The second expansion chamber 65 is located outward in the second direction from the second connecting portion 41 of the third diverting passage 45, which is connected to the third outlet portion 26C. Thus, the fresh air that has flowed backward to the EGR device 20 from the third branch passage portion 12C is likely to be dispersed to the second expansion chamber 65 from the third outlet portion 26C and stagnate in the second expansion chamber 65. As a result, the fresh air that has flowed backward is less likely to join the EGR gas that flows from the inlet portion 25 to the fourth outlet portion 26D.

When fresh air flows backward from the first outlet portion 26A and the fourth outlet portion 26D, the fresh air is less likely to be mixed with EGR gas since the lengths of the first diverting passage 35 and the fourth diverting passage 50 are longer than the lengths of the second diverting passage 40 and the third diverting passage 45.

As described above, the present embodiment limits mixing of fresh air into EGR gas, thereby ensuring a sufficient amount of EGR gas.

(2) The fresh air that has flowed backward from the intake passage to the EGR device 20 through the second outlet portion 26B is likely to flow in the first direction along the second connecting portion 41. In the present embodiment, the first expansion chamber 60 is expanded from the second connecting portion 41 in the second direction, the second direction being different from the first direction in which the second connecting portion 41 extends. Thus, the fresh air that has flowed from the second outlet portion 26B to the second connecting portion 41 and is dispersed into the first expansion chamber 60 is likely to stagnate in the first expansion chamber 60. This further limits mixing of fresh air into EGR gas. The second expansion chamber 65, which has the same structure as the first expansion chamber 60, achieves the same operation and advantages.

(3) The EGR device 20 of the present embodiment includes the first partition 70, which separates the first expansion chamber 60 and the second diverting passage 40 from each other. In the second diverting passage 40, the first partition 70 is curved from an upstream section closer to the inlet portion 25 to a downstream section closer to the second outlet portion 26B. Also, the first partition 70 guides the flow of EGR gas from the inlet portion 25 toward the second outlet portion 26B. This structure prevents the first expansion chamber 60 from hindering the flow of EGR gas from the inlet portion 25 to the second outlet portion 26B. This prevents distribution of EGR gas to the second outlet portion 26B from being reduced in the structure in which the first expansion chamber 60 is located on the outer side of the second connecting portion 41. The second partition 75, which separates the second expansion chamber 65 and the third diverting passage 45 from each other, has the same structure as the first partition 70. Thus, the second partition 75 prevents distribution of EGR gas to the third outlet portion 26C from being reduced.

(4) When the fresh air that has flowed backward to the first expansion chamber 60 stagnates, water contained in the fresh air collects on the wall surface of the first expansion chamber 60, so that water droplets form. In the present embodiment, the first expansion chamber 60 includes the bottom wall 60A. The bottom wall 60A is inclined so that it becomes lower in the vertical direction toward the section connected to the second connecting portion 41. That is, the bottom wall 60A slopes down in the vertical direction toward the second outlet portion 26B.

Figure 5:
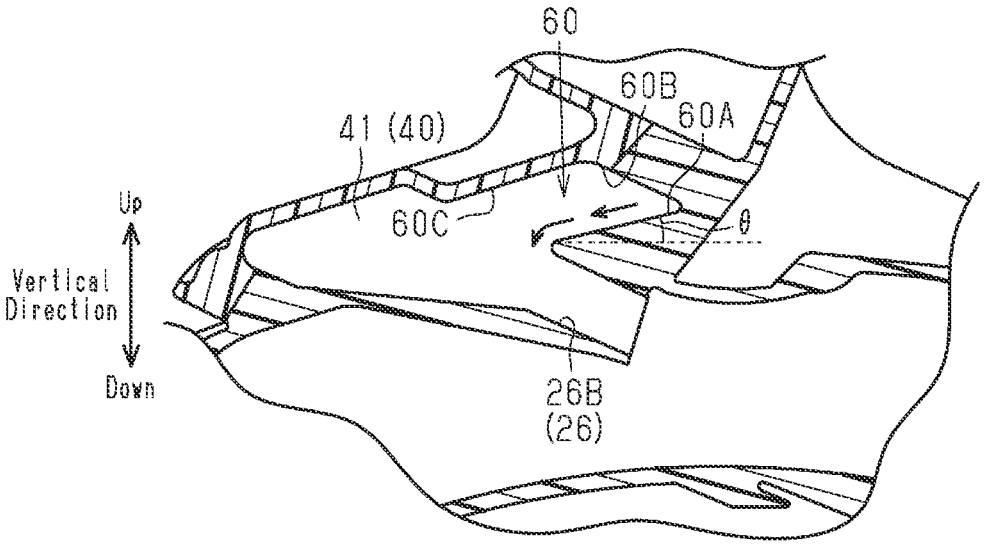
FIG. 5 is a cross-sectional view schematically showing flows of water droplets in an expansion chamber of the EGR device shown in FIG. 1.

Accordingly, droplets on the wall surface of the first expansion chamber 60 are easily moved toward the second connecting portion 41 and thus toward the second outlet portion 26B, as indicated by the solid arrows in FIG. 5. This prevents water from stagnating in the first expansion chamber 60. The second expansion chamber 65, which has the same structure as the first expansion chamber 60, achieves the same operation and advantages.

The present embodiment may be modified as follows. The present embodiment and the following modifications can be combined as long as the combined modifications remain technically consistent with each other.

Either one of the first expansion chamber 60 or the second expansion chamber 65 may be omitted. The passage portion 30 may include an expansion chamber that is expanded outward from the first connecting portion 36 of at least one of the first diverting passage 35 and the fourth diverting passage 50.

In the above-described embodiment, the first expansion chamber 60 and the second expansion chamber 65 are each provided with the bottom wall 60A, which is inclined so that it becomes lower in the vertical direction toward the section connected to the second connecting portion 41. This structure may be changed. For example, the bottom wall 60A may be arranged to be horizontal. Alternatively, the bottom wall 60A may be inclined so that it becomes lower in the vertical direction as the distance from the connected section increases.

In the above-described embodiment, the first partition 70 and the second partition 75 are curved so as to guide the flow of EGR gas from the inlet portion 25 toward the second outlet portion 26B and toward the third outlet portion 26C. In place of this structure, one of the first partition 70 and the second partition 75 may be straight without being curved.

In the above-described embodiment, the passage portion 30 includes the distribution chamber 32, the diverting passages 33, the first expansion chamber 60, and the second expansion chamber 65. However, a passage portion having a different structure may be employed. For example, the structure illustrated in FIG. 6 may be employed.

Figure 6:
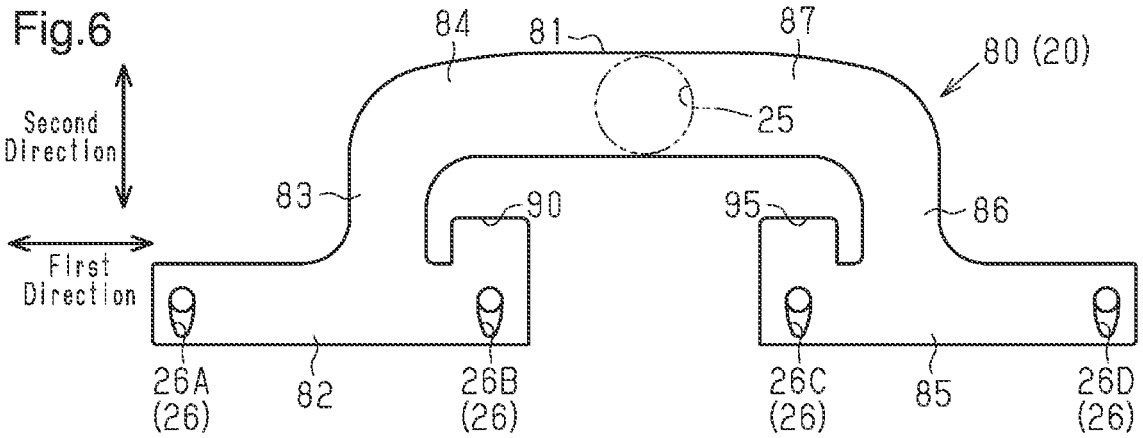
FIG. 6 is a schematic diagram showing a structure of a passage portion of an EGR device according to a modification.

As shown in FIG. 6, a passage portion 80 includes a main passage 81, which allows gas to flow between the inlet portion 25 and the outlet portions 26. The main passage 81 includes a first connecting portion 82. The first connecting portion 82 extends in a first direction (left-right direction in FIG. 6) and linearly connects the first outlet portion 26A and the second outlet portion 26B to each other. The main passage 81 includes a first common portion 83 and a first continuous portion 84. The first common portion 83 extends from a middle section of the first connecting portion 82 in a second direction (up-down direction in FIG. 6), the second direction being orthogonal to the first connecting portion 82. The first continuous portion 84 connects the first common portion 83 and the inlet portion 25 to each other. Also, the main passage 81 includes a second connecting portion 85. The second connecting portion 85 extends in the first direction to linearly connect the third outlet portion 26C and the fourth outlet portion 26D to each other. The main passage 81 includes a second common portion 86 and a second continuous portion 87. The second common portion 86 extends from a middle section of the second connecting portion 85 in the second direction, which is orthogonal to the second connecting portion 85. The second continuous portion 87 connects the second common portion 86 and the inlet portion 25 to each other. In this structure, the passage through which EGR gas flows from the inlet portion 25 to the first outlet portion 26A and the passage through which EGR gas flows from the inlet portion 25 to the second outlet portion 26B partly overlap with each other. Also, the passage through which EGR gas flows from the inlet portion 25 to the third outlet portion 26C and the passage through which EGR gas flows from the inlet portion 25 to the fourth outlet portion 26D partly overlap with each other.

The passage portion 80 includes a third expansion chamber 90, which is expanded outward from the first connecting portion 82, and a fourth expansion chamber 95, which is expanded outward from the second connecting portion 85. The third expansion chamber 90 is expanded from the first connecting portion 82 in a second direction, which is different from the first direction. That is, the third expansion chamber 90 is expanded from the first connecting portion 82 toward the first continuous portion 84 (upward as viewed in FIG. 6). The fourth expansion chamber 95 is expanded from the second connecting portion 85 in the second direction, which is different from the first direction. That is, the fourth expansion chamber 95 is expanded from the second connecting portion 85 toward the second continuous portion 87 (upward as viewed in FIG. 6). The structures of the third expansion chamber 90 and the fourth expansion chamber 95 are the same as the above-described structures of the first expansion chamber 60 and the second expansion chamber 65.

Figure 7:
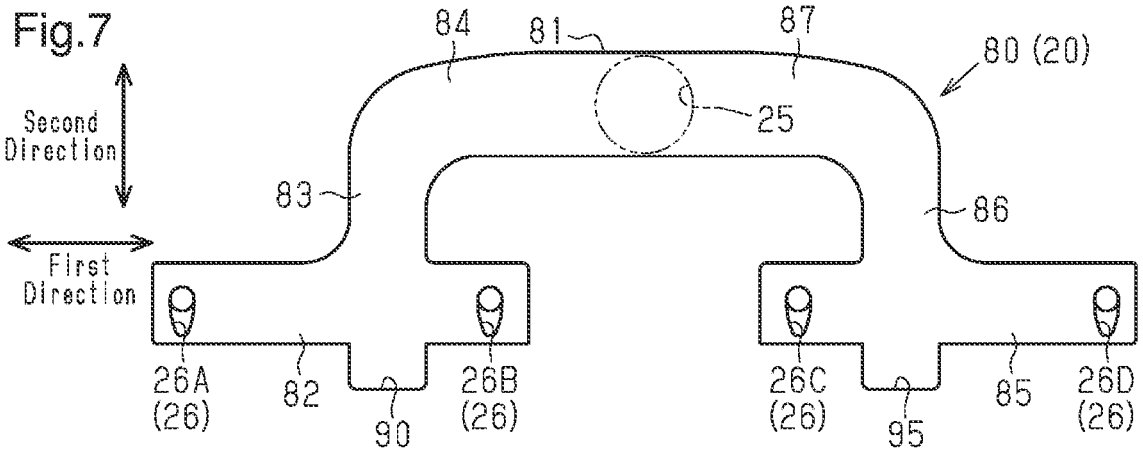
FIG. 7 is a schematic diagram showing a structure of a passage portion of an EGR device according to a modification.

As shown in FIG. 7, the third expansion chamber 90 can be expanded outward in the second direction (downward as viewed in FIG. 7) from the middle section of the first connecting portion 82. Also, the fourth expansion chamber 95 can be expanded outward in the second direction (downward as viewed in FIG. 7) from the middle section of the second connecting portion 85.

The configuration described in FIGS. 6 and 7 achieves the same operation and advantages described in the above-described items (1) to (4).

In the above-described embodiments, the expansion chambers may be expanded from the connecting portions in the first direction.

The above-described embodiments illustrate examples in which the EGR device 20 is provided with four outlet portions 26. However, the number of the outlet portions 26 may be any number greater than one.

The above-described embodiments illustrate examples in which the EGR device 20 is formed integrally with the intake manifold 10. However, the structure of the EGR device 20 is not limited to this. For example, the EGR device 20 may be formed separately from the intake manifold 10. The EGR device 20 may be attached to a branch passage portion of an intake device other than the intake manifold 10.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An EGR device configured to recirculate, as an EGR gas, some of an exhaust gas discharged from an internal combustion engine to branch passage portions provided in an intake passage, the EGR device comprising:

an inlet portion into which the EGR gas is introduced;

a first outlet portion and a second outlet portion that are connected to different ones of the branch passage portions, the first outlet portion and the second outlet portion each conducting, to the corresponding branch passage portion, the EGR gas that has been introduced through the inlet portion; and a passage portion that allows gas to flow between the inlet portion and the first outlet portion and between the inlet portion and the second outlet portion, wherein the passage portion includes:

a main passage that connects the inlet portion to the first outlet portion and to the second outlet portion; and an expansion chamber that is expanded outward from the main passage, the main passage includes a connecting portion, the connecting portion being connected to the second outlet portion and extending in a first direction, and the expansion chamber is expanded outward from the connecting portion, wherein a first portion of the main passage that extends from the inlet portion to the first outlet portion is longer than a second portion of the main passage that extends from the inlet portion to the second outlet portion, wherein a section of the first portion of the main passage that connects to the first outlet portion extends towards the first outlet portion, and the connecting portion also extends towards the first outlet portion to connect to the second outlet portion, wherein the expansion chamber is expanded from the connecting portion in a direction different from the first direction, and wherein the expansion chamber includes a bottom surface that faces upwards away from the second outlet portion, the bottom surface being inclined so that the bottom surface slopes down in a vertical direction towards the second outlet portion.

2. The EGR device according to claim 1, further comprising:

a partition that separates the expansion chamber and the main passage from each other, wherein in the main passage, the partition is curved from an upstream section closer to the inlet portion to a downstream section closer to the second outlet portion, and the partition guides the EGR gas that flows from the inlet portion to the second outlet portion.

3. The EGR device according to claim 2, wherein the partition is curved with respect to a second direction, which is orthogonal to the first direction, to extend towards the second outlet portion.

* * * * *